US007244112B2

(12) United States Patent
Wang

(10) Patent No.: US 7,244,112 B2
(45) Date of Patent: Jul. 17, 2007

(54) PUMP HAVING A REMOVABLE COVER

(76) Inventor: Wen-Chang Wang, No. 666, Sec. 1, Chung Cheng Rd., Jen Te Hsiang, Tainan Hsien (TW)

( * ) Notice: Subject to any disclaimer, the term of this patent is extended or adjusted under 35 U.S.C. 154(b) by 689 days.

(21) Appl. No.: 10/781,545

(22) Filed: Feb. 17, 2004

(65) Prior Publication Data

US 2005/0180866 A1 Aug. 18, 2005

(51) Int. Cl.
*F04B 39/00* (2006.01)

(52) U.S. Cl. ..... 417/572

(58) Field of Classification Search ..... 417/572; 220/315, 324; 222/402; 239/373
See application file for complete search history.

(56) References Cited

U.S. PATENT DOCUMENTS 3,709,409 A * 1/1973 Collins ..... 222/402
5,049,770 A * 9/1991 Gaeth et al. ..... 310/89
5,897,300 A * 4/1999 Luedtke ..... 417/477.9
6,286,553 B1 * 9/2001 Morgan ..... 138/89
6,609,901 B2 * 8/2003 Bussmann ..... 417/572
6,814,264 B2 * 11/2004 Chen ..... 222/402
2005/0092171 A1 * 5/2005 Shu ..... 92/72

* cited by examiner

*Primary Examiner*—Charles Freay
*Assistant Examiner*—Vikansha Dwivedi
(74) *Attorney, Agent, or Firm*—Alan Kamrath; Kamrath & Associates PA

(57) ABSTRACT

A pump includes a main body, a removable cover, an urging plate, an elastic member, and a control knob. Thus, the removable cover is locked on and unlocked from the main body easily, rapidly and conveniently by rotation of the control knob, thereby facilitating the operator mounting the removable cover. In addition, the locking portion of each of the two end portions of the urging plate is closely locked in the locking hook of a respective one of the catch members of the main body by rotation of the control knob, so that the removable cover is locked on the main body rigidly and stably.

13 Claims, 5 Drawing Sheets

PUMP HAVING A REMOVABLE COVER

BACKGROUND OF THE INVENTION

1. Field of the Invention

The present invention relates to a pump having a removable cover, and more particularly to a pump, wherein the removable cover is mounted and detached easily, rapidly and conveniently, thereby facilitating the operator mounting the removable cover.

2. Description of the Related Art

A conventional pump comprises a main body, and a cover mounted on the main body. However, the cover cannot be mounted on or detached from the main body easily and conveniently, thereby causing inconvenience to the operator when mounting the cover.

SUMMARY OF THE INVENTION

The primary objective of the present invention is to provide a pump, wherein the removable cover is mounted and detached easily, rapidly and conveniently, thereby facilitating the operator mounting the removable cover.

Another objective of the present invention is to provide a pump, wherein the removable cover is locked on and unlocked from the main body easily, rapidly and conveniently by rotation of the control knob, thereby facilitating the operator mounting the removable cover.

A further objective of the present invention is to provide a pump, wherein the distance between the first end and the pivot ear of each of the two end portions of the urging plate is much greater than that between the pivot ear and the locking portion, thereby saving the operator's energy.

A further objective of the present invention is to provide a pump, wherein the locking portion of each of the two end portions of the urging plate is closely locked in the locking hook of a respective one of the catch members of the main body by rotation of the control knob, so that the removable cover is locked on the main body rigidly and stably.

In accordance with the present invention, there is provided a pump, comprising a main body, a removable cover, an urging plate, and a control knob, wherein:

the main body has a periphery formed with a plurality of catch members each having a distal end forked with a locking hook;

the removable cover is mounted on the main body;

the urging plate is pivotally mounted on the removable cover and has two end portions each pivotally mounted on the periphery of the removable cover and each having a locking portion that is movable by pivot of the urging plate and is detachably locked in the locking hook of a respective one of the catch members of the main body; and the control knob is rotatably mounted on the urging plate and is urged on a mediate portion of the urging plate by rotation of the control knob.

Further benefits and advantages of the present invention will become apparent after a careful reading of the detailed description with appropriate reference to the accompanying drawings.

DETAILED DESCRIPTION OF THE INVENTION

Figure 1:
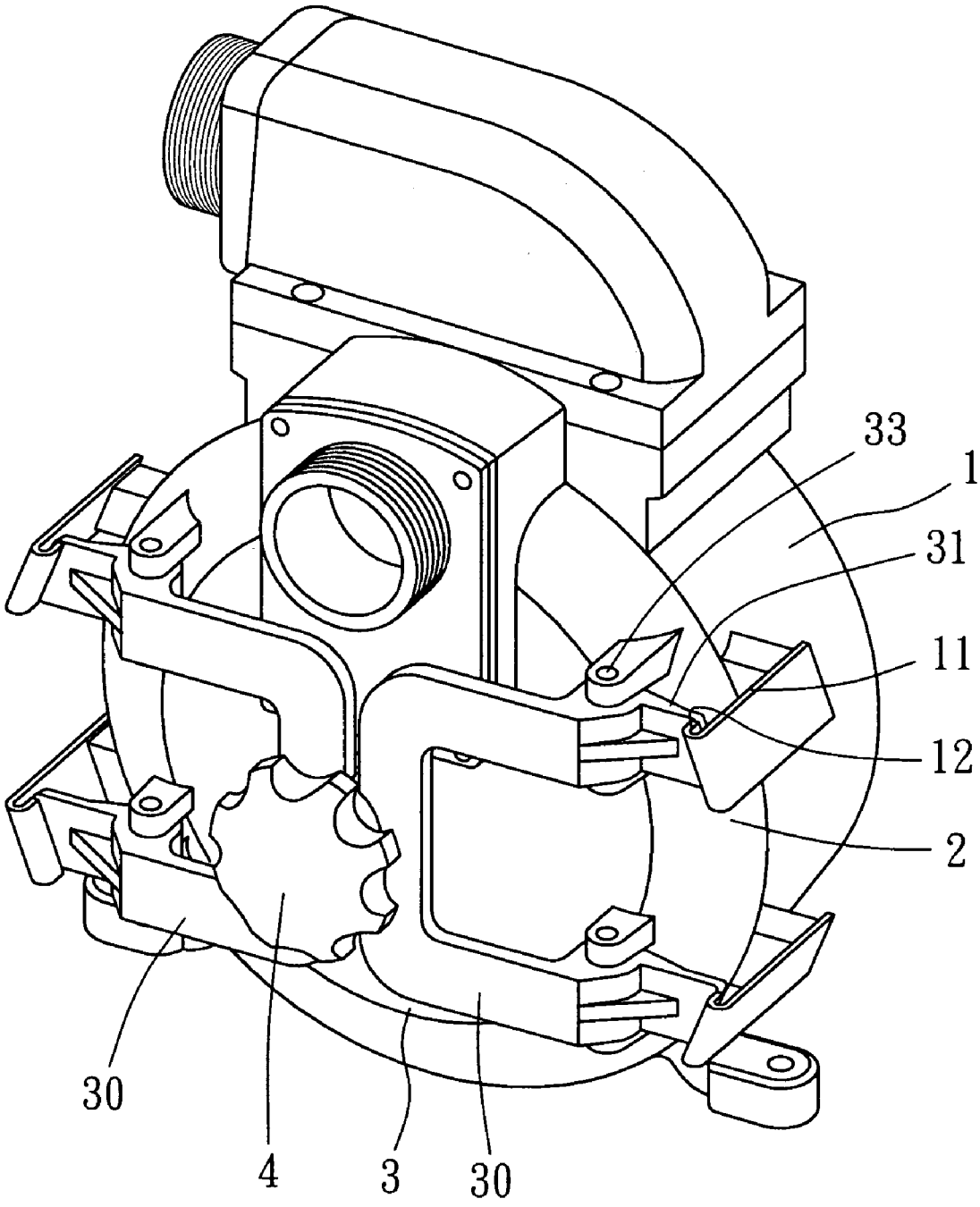
FIG. 1 is a perspective view of a pump in accordance with the preferred embodiment of the present invention.
Figure 2:
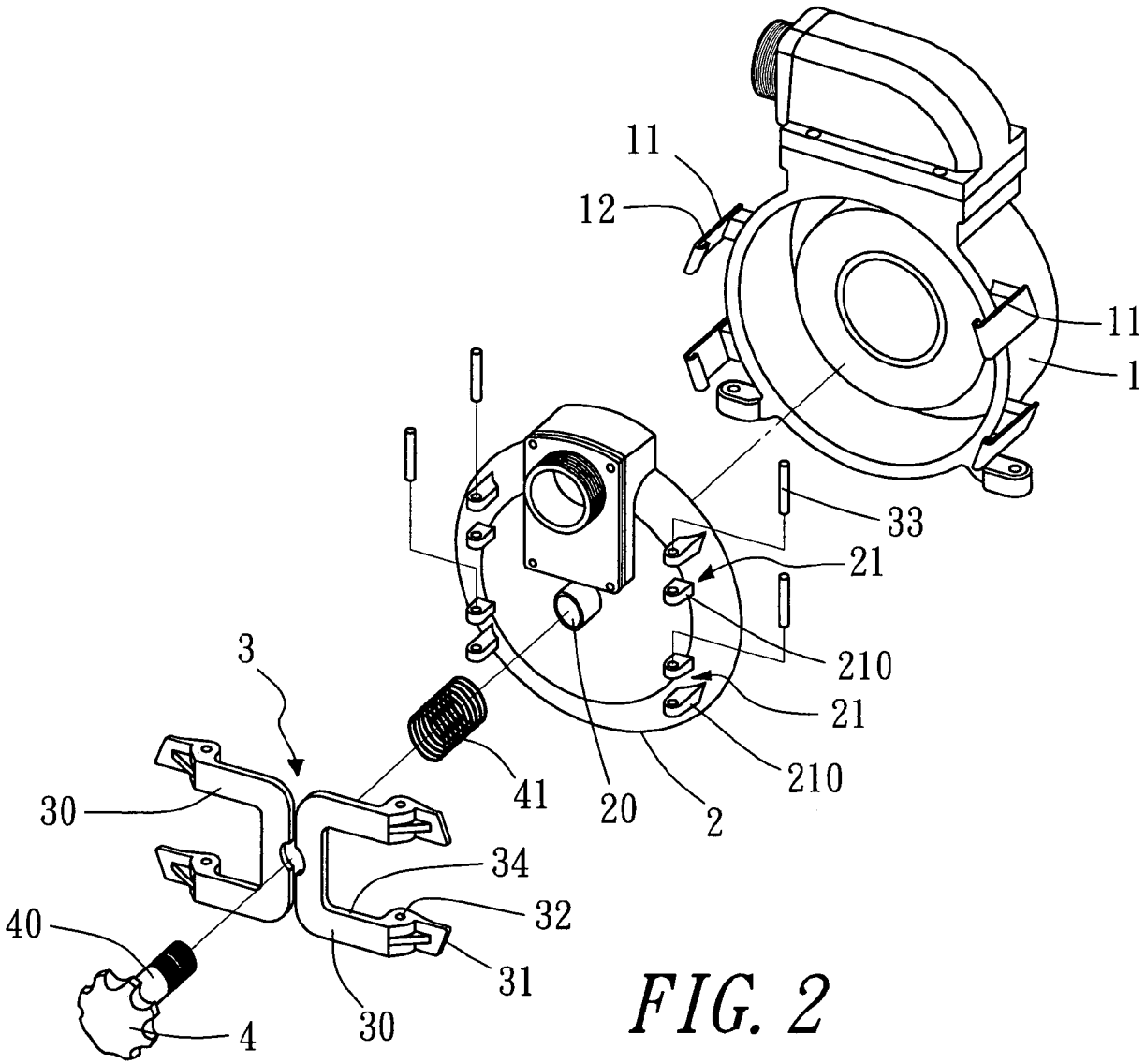
FIG. 2 is an exploded perspective view of the pump as shown in FIG. 1.
Figure 3:
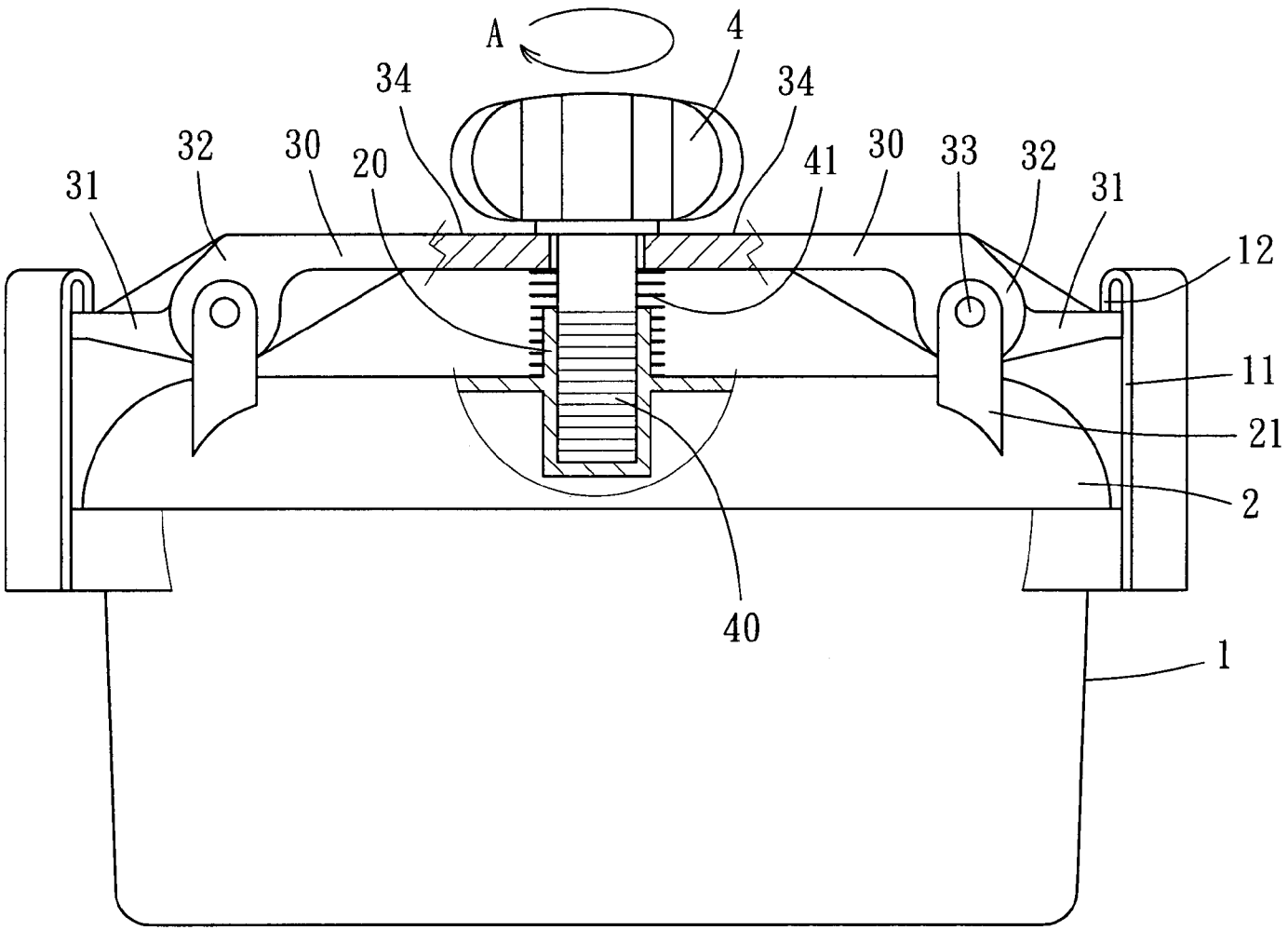
FIG. 3 is a partially plan cross-sectional view of the pump as shown in FIG. 1.

Referring to the drawings and initially to FIGS. 1–3, a pump in accordance with the preferred embodiment of the present invention comprises a main body 1, a removable cover 2, an urging plate 3, a control knob 4, and an elastic member 41.

The main body 1 has a periphery formed with a plurality of catch members 11 each having a distal end forked with a locking hook 12.

The removable cover 2 is mounted on the main body 1 and has a periphery formed with a plurality of pivot bases 21 each having two spaced support ears 210. The removable cover 2 has a center formed with a nut 20.

The urging plate 3 is pivotally mounted on the removable cover 2 and has two end portions 30 each pivotally mounted on the periphery of the removable cover 2. Preferably, the urging plate 3 is made of a flexible material.

Each of the two end portions 30 of the urging plate 3 is substantially U-shaped and has two spaced sections each having a first end 34, a mediate portion formed with a pivot ear 32 pivotally mounted on a respective one of the pivot bases 21 of the removable cover 2, and a second end formed with a locking portion 31 that is movable by pivot of the pivot ear 32 and is detachably locked in the locking hook 12 of a respective one of the catch members 11 of the main body 1 as shown in FIG. 3. Preferably, the pivot ear 32 of each of the two end portions 30 of the urging plate 3 is pivotally mounted between the two spaced support ears 210 of a respective one of the pivot bases 21 of the removable cover 2 by a pivot shaft 33.

The control knob 4 is rotatably mounted on the urging plate 3 and is urged on a mediate portion of the urging plate 3 by rotation of the control knob 4. The control knob 4 has a shank 40 extended through the mediate portion of the urging plate 3 and screwed into the nut 20 of the removable cover 2. Preferably, the shank 40 of the control knob 4 is a threaded rod.

The elastic member 41 is mounted on the nut 20 of the removable cover 2 and is urged between the removable cover 2 and the urging plate 3. In addition, the shank 40 of the control knob 4 is extended through the elastic member 41.

Figure 4:
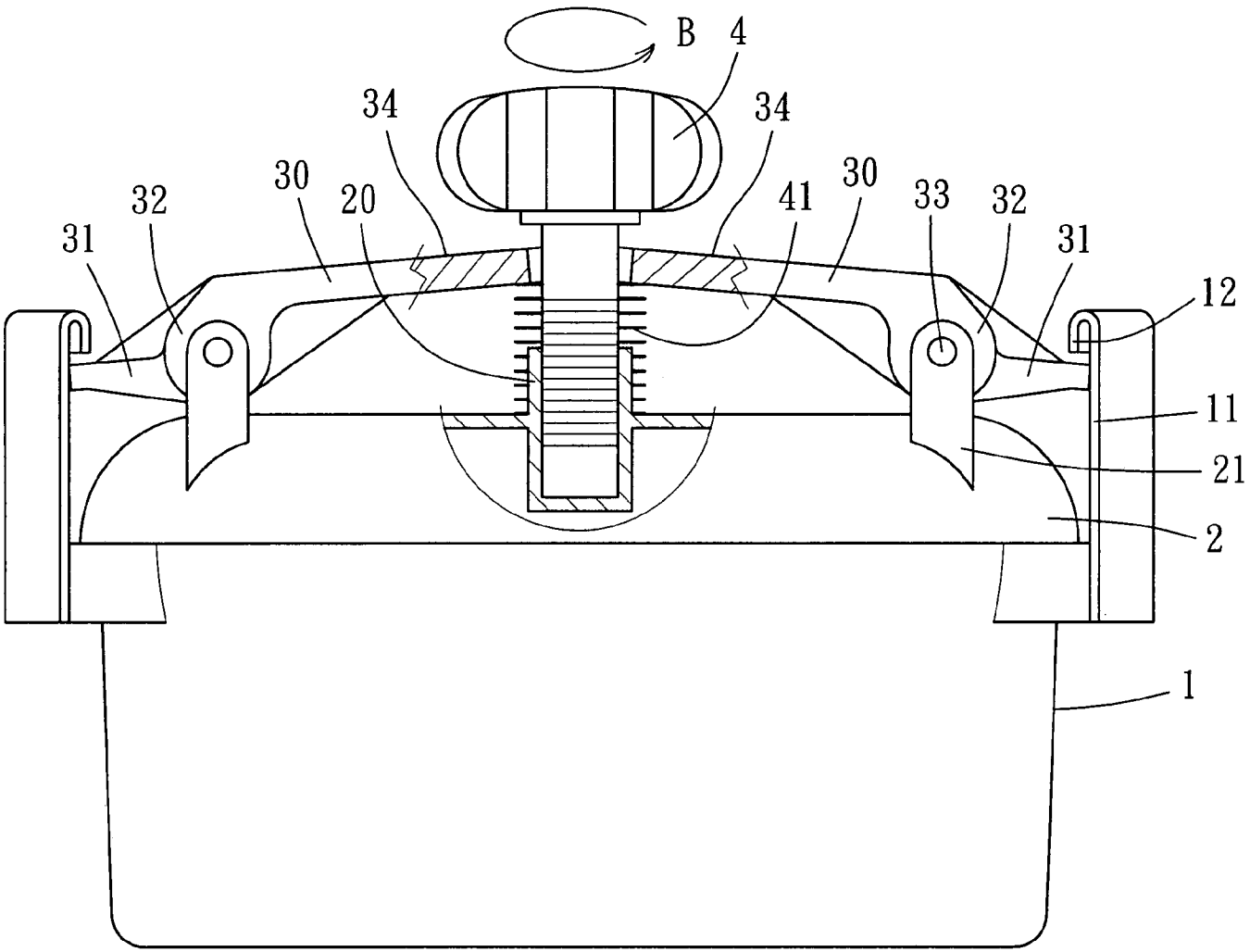
FIG. 4 is a schematic operational view of the pump as shown in FIG. 3.

In operation, referring to FIGS. 3 and 4 with reference to FIGS. 1 and 2, when the control knob 4 is rotated in the direction as indicated by the arrow "A" shown in FIG. 3, the shank 40 of the control knob 4 is further screwed into the nut 20 of the removable cover 2, so that the control knob 4 is urged on the mediate portion of the urging plate 3 to press the first end 34 of each of the two end portions 30 of the urging plate 3 to move toward the removable cover 2. Thus, the pivot ear 32 of each of the two end portions 30 of the urging plate 3 is pivoted about the pivot shaft 33, so that the locking portion 31 of each of the two end portions 30 of the urging plate 3 is movable by pivot of the pivot ear 32 and is locked in the locking hook 12 of a respective one of the catch members 11 of the main body 1 as shown in FIG. 3, thereby locking the removable cover 2 on the main body 1 by the urging plate 3 as shown in FIG. 1.

Alternatively, when the control knob 4 is reversely rotated in the direction as indicated by the arrow "B" shown in FIG. 4, the shank 40 of the control knob 4 is unscrewed from the nut 20 of the removable cover 2, so that the control knob 4 is detached from the mediate portion of the urging plate 3 to release the urging plate 3. In such a manner, the first end 34 of each of the two end portions 30 of the urging plate 3 is pressed by the restoring force of the elastic member 41 to move outward relative to the removable cover 2. Thus, the pivot ear 32 of each of the two end portions 30 of the urging plate 3 is pivoted about the pivot shaft 33, so that the locking portion 31 of each of the two end portions 30 of the urging plate 3 is movable by pivot of the pivot ear 32 and is detached from the locking hook 12 of a respective one of the catch members 11 of the main body 1 as shown in FIG. 4, thereby unlocking the removable cover 2 from the main body 1. Then, the removable cover 2 and the urging plate 3 are removed from the main body 1.

Accordingly, the removable cover 2 is locked on and unlocked from the main body 1 easily, rapidly and conveniently by rotation of the control knob 4, thereby facilitating the operator mounting the removable cover 2. In addition, the distance between the first end 34 and the pivot ear 32 of each of the two end portions 30 of the urging plate 3 is much greater than that between the pivot ear 32 and the locking portion 31, thereby saving the operator's energy. Further, the locking portion 31 of each of the two end portions 30 of the urging plate 3 is closely locked in the locking hook 12 of a respective one of the catch members 11 of the main body 1 by rotation of the control knob 4, so that the removable cover 2 is locked on the main body 1 rigidly and stably.

Figure 5:
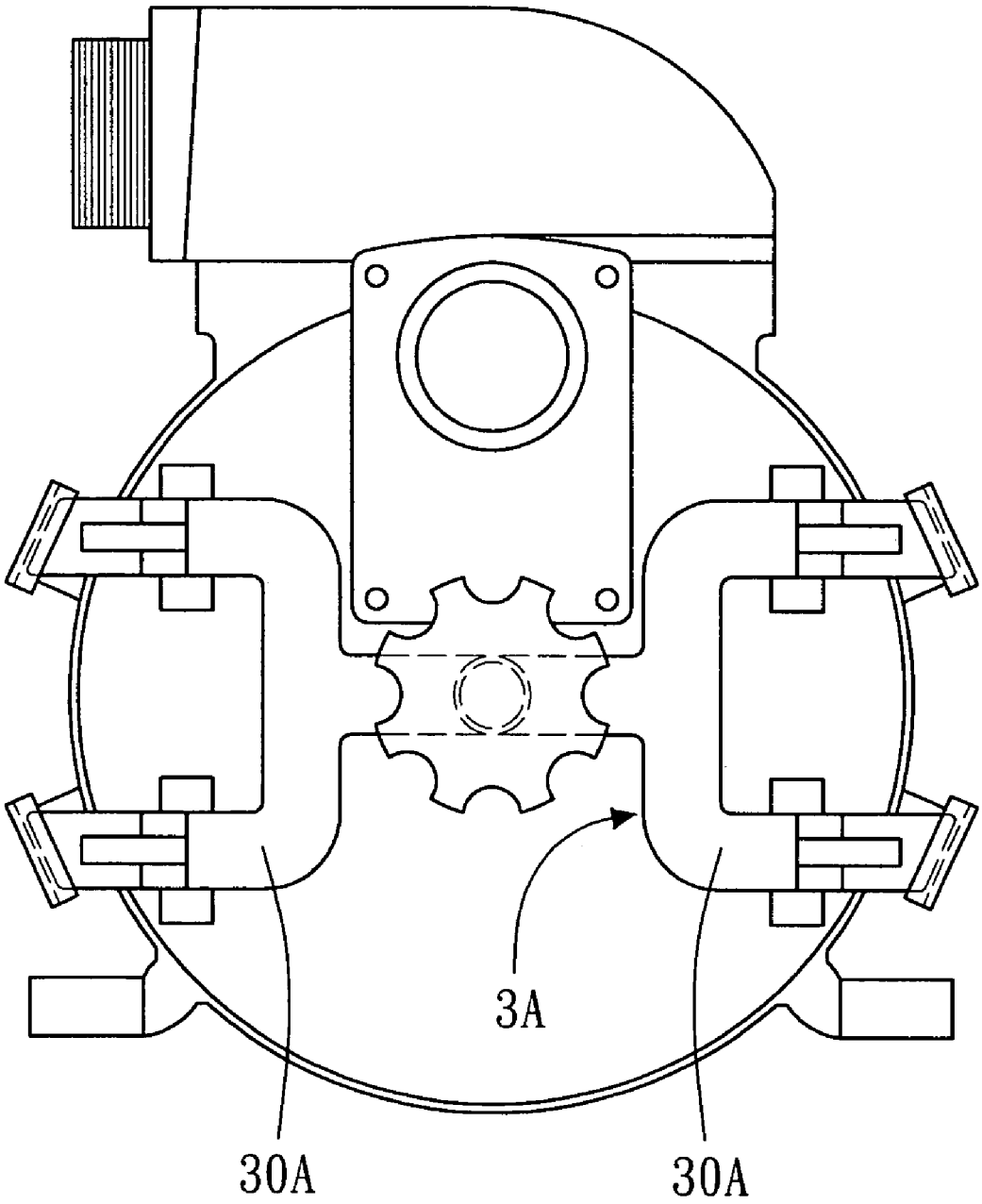
FIG. 5 is a plan view of a pump in accordance with another embodiment of the present invention.

Referring to FIG. 5, the urging plate 3A has a different configuration and includes two substantially Y-shaped end portions 30A.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pump, comprising a main body, a removable cover, an urging plate, and a control knob, wherein:

the main body has a periphery formed with a plurality of catch members each having a distal end forked with a locking hook;

the removable cover is mounted on the main body;

the urging plate is pivotally mounted on the removable cover and has two end portions each pivotally mounted on the periphery of the removable cover and each having a locking portion that is movable by pivot of the urging plate and is detachably locked in the locking hook of a respective one of the catch members of the main body; and the control knob is rotatably mounted on the urging plate and is urged on a mediate portion of the urging plate by rotation of the control knob.

2. The pump in accordance with claim 1, wherein each of the two end portions of the urging plate has a first end extended from the mediate portion of the urging plate, a mediate portion formed with a pivot ear pivotally mounted on the periphery of the removable cover and a second end formed with the locking portion.

3. The pump in accordance with claim 2, wherein the removable cover has a periphery formed with a plurality of pivot bases, and the pivot ear of each of the two end portions of the urging plate is pivotally mounted on a respective one of the pivot bases of the removable cover.

4. The pump in accordance with claim 3, wherein each of the pivot bases of the removable cover has two spaced support ears, and pivot ear of each of the two end portions of the urging plate is pivotally mounted between the two spaced support ears of a respective one of the pivot bases of the removable cover by a pivot shaft.

5. The pump in accordance with claim 2, wherein a distance between the first end and the pivot ear of each of the two end portions of the urging plate is much greater than that between the pivot ear and the locking portion.

6. The pump in accordance with claim 1, further comprising and an elastic member urged between the removable cover and the urging plate.

7. The pump in accordance with claim 6, wherein the removable cover has a center formed with a nut, and the elastic member is mounted on the nut of the removable cover.

8. The pump in accordance with claim 7, wherein the control knob has a shank extended through the mediate portion of the urging plate and screwed into the nut of the removable cover.

9. The pump in accordance with claim 8, wherein the shank of the control knob is extended through the elastic member.

10. The pump in accordance with claim 8, wherein the shank of the control knob is a threaded rod.

11. The pump in accordance with claim 1, wherein the urging plate is made of a flexible material.

12. The pump in accordance with claim 1, wherein each of the two end portions of the urging plate is substantially U-shaped.

13. The pump in accordance with claim 1, wherein each of the two end portions of the urging plate is substantially Y-shaped.

* * * * *